US005161436A

United States Patent [19]

Stevenson

[11] Patent Number: 5,161,436

[45] Date of Patent: Nov. 10, 1992

[54] UNITARY TOOL FOR REMOVING RADIATOR CAPS

[76] Inventor: Robert L. Stevenson, 7320 W. 87th St., Overland Park, Kans. 66212

[21] Appl. No.: 655,551

[22] Filed: Feb. 12, 1991

[51] Int. Cl.[5] ..... B67B 7/00

[52] U.S. Cl. ..... 81/3.41; 81/3.09; 81/3.15

[58] Field of Search ..... 81/3.41, 3.09, 3.07, 81/3.15, 3.4, 3.42, 176.1, 176.15, 176.2, 176.3; 220/DIG. 32; 16/126, 114 R

[56] References Cited

U.S. PATENT DOCUMENTS

| | | | |
|---|---|---|---|
| 1,634,284 | 7/1927 | Dunzweiler et al. | 16/DIG. 15 |
| 3,007,357 | 11/1961 | Nalley | 81/3.4 |
| 3,014,389 | 12/1961 | O'Hara | 81/90 |
| 3,048,067 | 8/1962 | Miles et al. | 81/3.1 |
| 3,185,272 | 5/1965 | Chance | 16/126 |
| 3,186,263 | 6/1965 | Grate | 81/3.1 |
| 3,262,247 | 7/1966 | Schalle | 53/317 |
| 3,274,864 | 9/1966 | Chapman | 81/90 |
| 3,562,849 | 2/1971 | Brayshaw | 16/126 |
| 3,638,515 | 2/1972 | Lentz et al. | 81/3.1 |
| 3,785,225 | 1/1974 | McKenna et al. | 81/3.09 |
| 3,837,242 | 9/1974 | Harper | 81/3.1 |
| 3,885,477 | 5/1975 | Shook | 81/3.1 |
| 4,095,492 | 6/1978 | Makela | 81/461 |
| 4,189,037 | 2/1980 | Szabo | 16/126 |
| 4,697,480 | 10/1987 | Robideau | 81/3.09 |
| 4,846,025 | 7/1989 | Keller et al. | 81/3.09 |
| 5,003,845 | 4/1991 | Roy et al. | 81/3.09 |
| 5,005,255 | 4/1991 | Pare et al. | 16/126 |

*Primary Examiner*—Frank T. Yost
*Assistant Examiner*—Hiuei-Siu Payer
*Attorney, Agent, or Firm*—Kenneth W. Iles

[57] ABSTRACT

A radiator cap loosening and removal tool includes a generally U-shaped bail or handle pivotally attached to a base, which is in turn fastened to a radiator cap by self tapping sheet metal screws. An alterative embodiment comprises a U-shaped bail or handle whose legs embrace the radiator cap and are pivotally fastened thereto by screws or rivets.

14 Claims, 3 Drawing Sheets

UNITARY TOOL FOR REMOVING RADIATOR CAPS

FIELD OF THE INVENTION

This invention relates to tools for removing automobile radiator caps, and in particular to a tool that, without modification, fits all different styles of automobile radiator caps now in use.

BACKGROUND OF THE INVENTION

There are numerous radiator cap removal tools in the prior art. Such tools are deficient because they are not suitable for use with all styles of radiator caps. In addition, use of such tools often places the user's hand so close to the radiator cap that hot fluid is likely to spray the hand when removing the radiator cap from a hot radiator. Many such tools cannot be used on radiator caps that are not mounted on the top of the radiator. Many such tools are specialty tools that have a single purpose. If they are not kept in the car at all times, they may not be available when the radiator overheats.

Often such tools enable the user to loosen the radiator cap, but do not allow the same tool to be used in actually removing the radiator cap from the radiator filler neck. A separate tool, such as a pair of pliers or a rag, which are often unavailable, is needed for actually removing the hot radiator cap.

Furthermore, all such tools are often misplaced simply because they are used so infrequently that the owner cannot remember to keep them with the car, or easily recall where he left them. Finally, many such tools are awkwardly shaped and accordingly, unwieldy in use.

Furthermore, most modern automobile radiators are equipped with a coolant recovery system that collects and condenses vapors escaping from the radiator during operation of the engine. The condensed fluids are returned to the radiator and engine cooling system by ambient air pressure that exceeds the fluid pressure inside the cooling system when the engine cools. When such a coolant recovery system is employed, the radiator cap typically is designed to be loosened by turning about one-quarter turn counterclockwise, where t engages a pressure release stop-tooth on the outer flange of the radiator filler neck. When the radiator cap is in this position, vapor pressure will be released from the radiator and cooling system, but the cap cannot be removed from the radiator filler neck, thereby reducing the chance of injury from splashing hot fluid. After the cooling system pressure reaches equilibrium with the ambient air pressure, the radiator cap can be safely removed by depressing it firmly and rotating it approximately another one-half turn counterclockwise, allowing the radiator cap to be lifted free of the filler neck. Most tools for removing radiator caps, including the human hand, require the user to press down hard on the radiator cap to develop a sufficient grip to overcome the friction between the radiator cap gasket and the lip of the filler neck and to rotate the cap.

When the radiator cap is thus depressed, it is very easy, and all too common, to rotate the radiator cap past the pressure release stop-tooth. If this happens and the radiator is hot, the cap is likely to be explosively thrown from the radiator as superheated fluids gush out the radiator filler neck, and injury to the person is very likely. Such injuries can be very serious and may include, for example, the loss of sight. In addition, exposure to antifreeze can seriously damage the car's paint.

Therefore, a need exists for a tool for removing radiator caps that can be used without modification for all styles of radiator caps; that will keep the user's hand sufficiently removed from the radiator cap to prevent hot fluid from spraying the user's hand; that will conveniently remove a radiator cap that is not mounted on the top of the radiator; that is easy to use; that will not become lost; that is always available when needed; that can easily be used for actually removing the radiator cap from the radiator neck, as well as for loosening it; and that is simple and inexpensive to design and manufacture.

OBJECTS OF THE INVENTION

It is, therefore, the primary object of the present invention to provide a tool for loosening a radiator cap that can be used without modification to remove any style of automobile radiator cap currently in use, by providing a tool for removing radiator caps comprising a base plate having two base plate legs and two upwardly protruding opposed ears, each ear including an aperture therethrough; a generally U-shaped bail or handle including two depending handle legs connected by a connecting portion of the U-shaped bail or handle, and each said leg including an aperture; said legs of said U-shaped bail or handle fastened to said base plate by pins and a means for attaching said base plate legs to a radiator cap. In another embodiment, the tool for removing radiator caps consists of a unitary radiator cap and tool for removing the radiator cap from a radiator filler neck comprising a generally U-shaped bail or handle having a pair of depending legs connected by a connecting portion, each leg including an aperture; a radiator cap having two apertures through the outer depending skirt portion of the radiator cap, with the apertures being opposite one another; two gripping mechanical fasteners penetrating said apertures in said legs, and said apertures in said skirt. The fasteners may be rivets, cotter pins, screws and nuts, or other suitable fasteners.

It is another object of the present invention to provide a tool for removing a radiator cap as aforesaid that keeps the user's hand sufficiently removed from the radiator cap to prevent hot fluid from spraying the user's hand when the radiator cap is removed from a hot radiator.

It is a further object of the present invention to provide a tool for removing radiator caps as aforesaid, that can readily accommodate radiator caps that are not mounted on the top of the radiator.

It is still another object of the present invention to provide a tool for removing radiator caps as aforesaid, that is easy to use.

It is another object of the present invention to provide a tool for removing radiator caps as aforesaid that is not likely to become lost.

It is another object of the present invention to provide a tool for removing radiator caps as aforesaid that is always available when needed.

It is still another object of the present invention to provide a tool for removing radiator caps as aforesaid comprising a tool that will enable a user to rotate a radiator cap to the pressure release position without a danger of rotating it past that position, and to remove the loosened radiator cap from the radiator filler neck after any pressure in the cooling system has been released, without the user needing to touch the radiator cap.

It is another object of the present invention to provide a tool for removing radiator caps as aforesaid that is simple and inexpensive to design and manufacture.

Other objects and advantages of the present invention will become apparent from the following description taken in connection with the accompanying drawings, wherein is set forth by way of illustration and example, the preferred embodiments of this invention and the best mode currently known to the inventor for carrying out the invention.

DETAILED DESCRIPTION OF THE PREFERRED EMBODIMENT

As required, detailed embodiments of the present invention are disclosed herein. It is, however, to be understood that the disclosed embodiments are merely illustrative of the invention, which may be embodied in various forms. Therefore, specific structural and functional details disclosed herein are not to be interpreted as limiting, but merely to provide the proper basis for the claims and as a representative basis for teaching one skilled in the art to employ the tools for removing radiator caps disclosed herein in virtually any appropriately specific and detailed structure.

Figure 1:
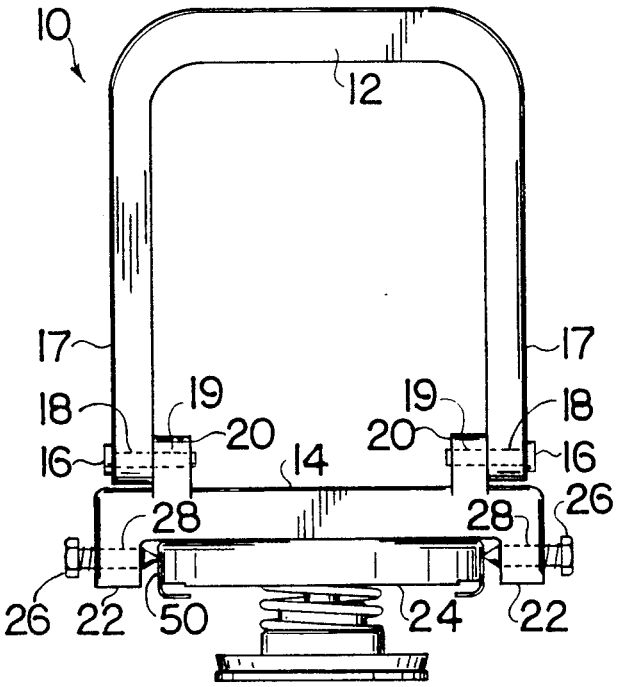
FIG. 1 is a front elevation of a preferred embodiment of the tool for removing radiator caps shown with the handle in an upright position.

Referring to FIG. 1, there is shown generally a tool 10 for removing radiator caps 24, including a U-shaped bail or handle 12 having a pair of depending legs 17 that straddle ears 20 which are attached to a base plate 14 by pins 16 or other suitable fasteners that penetrate apertures 18 in the U-shaped bail or handle 12 and apertures 19 and in the two ears 20, which comprise a portion of the base plate 14. The ears 20 are upward projecting well-defined perpendicular protruberances (as viewed in FIG. 1) that are integrally formed in the base plate 14. Alternatively, the ears 20 may be separately fashioned pieces that are attached to base plate 14 by gluing, fusing, or other suitable means. This means for connecting bail or handle 12 to base plate 14 allows for the bail or handle 12 to pivot approximately one hundred eighty degrees (180°) about the axis of pins 16. (See FIG. 3, which illustrates tool 10 with bail or handle 12 in the down position.) Naturally, screws and nuts, rivets, cotter pins, or any other suitable fastener may be employed to join the bail or handle 12 to the ears 20.

Base plate legs 22 of the base plate 14 straddle the outside perimeter of the cap portion of the radiator cap 24. Self-tapping sheet metal screws 26 are inserted through apertures 28 in the base plate legs 22 and are tightened until they grip the radiator cap 24 firmly. It is not necessary to tap the apertures 28. If desired, the outer lip of radiator cap 24 may be dented with a center punch and hammer, or other machines to allow screws 26 to grip radiator cap 24 tightly with greater ease. Alternatively, the base plate legs 22 may be attached or fastened to the depending outer skirt 50 of the radiator cap 24 by a suitable adhesive such as an epoxy.

Figure 2:
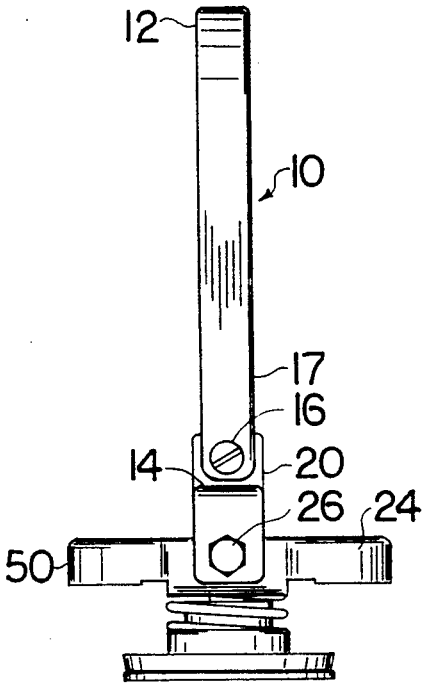
FIG. 2 is a side elevation of the device shown in FIG. 1.
Figure 3:
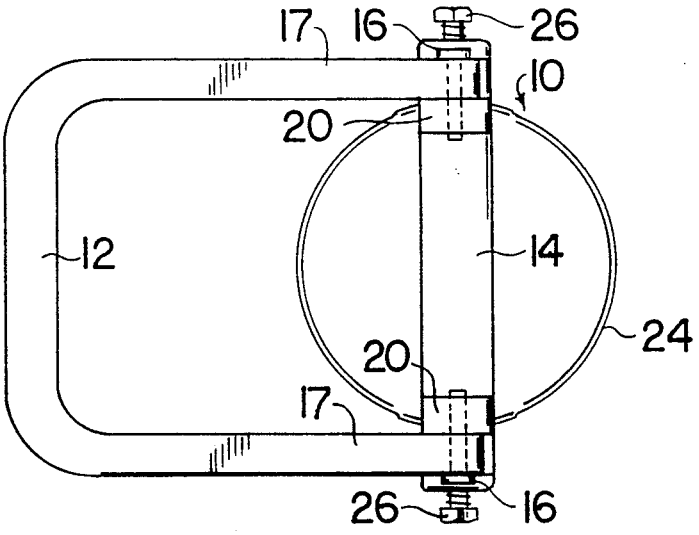
FIG. 3 is a plan view of a tool for removing radiator caps according to the present invention shown with the handle in the down position.
Figure 4:
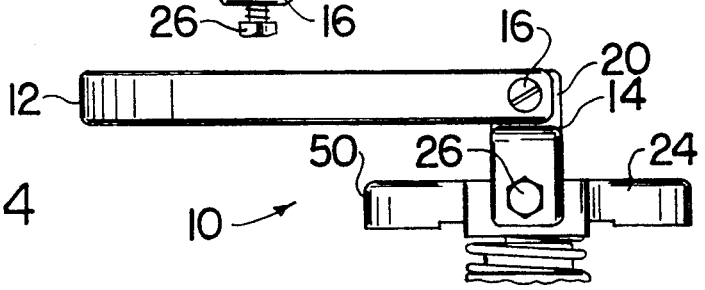
FIG. 4 is a side elevation of the device shown in FIG. 3.

The tool 10 is also illustrated in FIGS. 2, 3 and 4 for the purpose of providing a clear three dimensional depiction of the tool 10. FIG. 3 shows the tool 10 in the relaxed or non-use, position, that is, with U-shaped bail or handle 12 in the lowered position, which allows the hood of the car to be closed without interference from tool 10. FIGS. 1 and 2 show tool 10 with the U-shaped bail or handle 12 in the up position, which is typically used for actually removing radiator cap 24 from the radiator filler neck (not shown). It is intended that the tool 10, will not be removed from the radiator cap 24 after installation but will remain in place permanently.

The U-shaped bail or handle 12 and base plate 14 may be conveniently made from polyvinylchloride, which is an excellent material for the intended use of the tool 10, because polyvinylchloride is a good heat insulator; has a very low specific heat capacity; and has a very low coefficient of expansion. Alternatively, the U-shaped bail or handle 12 may be made of any suitable plastic, or other suitable material, such as heavy gauge wire. Further, the U-shaped bail or handle 12 may be manufactured in a variety of shapes, such as semi-circular, rectangular, and so forth, that allows U-shaped bail or handle 12 to swing about the axis of pins 16.

Figure 5:
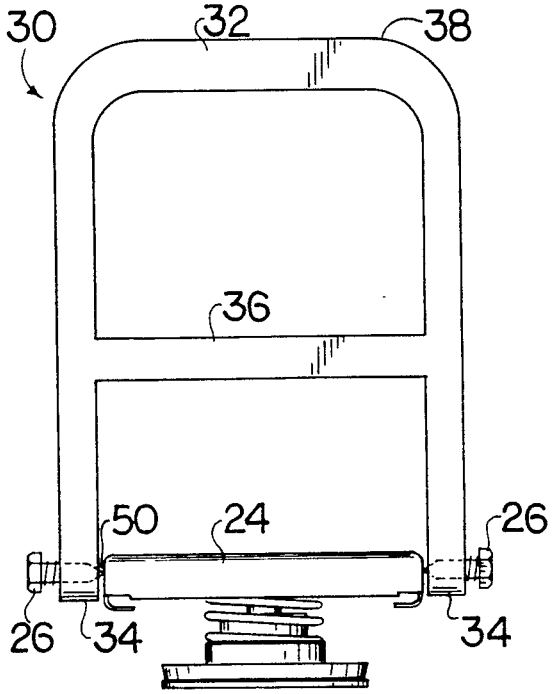
FIG. 5 is a front elevation of an alternative embodiment of the tool for removing radiator caps.

Referring to FIG. 5, there is shown an alternative embodiment of the tool for removing radiator caps, shown generally at 30, and comprising U-shaped bail or handle 32, whose open ends straddle the perimeter portion of radiator cap 24 at points opposite one another and in the case of a circular radiator cap, along a diameter, where they are held in place by self tapping sheet metal screws 26 in the manner described above. A brace 36 is fixed to a U-shaped bail or handle 32 at a position intermediate open ends 34 of the ball or handle 32 and a top portion 38 of the U-shaped bail or handle 32. The brace 36 may be fastened to the U-shaped bail or handle 32 by any convenient means such as, adhesives, fusing, gluing, or by mechanical fasteners such as screws. The preferred embodiment illustrated in FIG. 5 may also be made from polyvinylchloride or any other convenient material.

Figure 6:
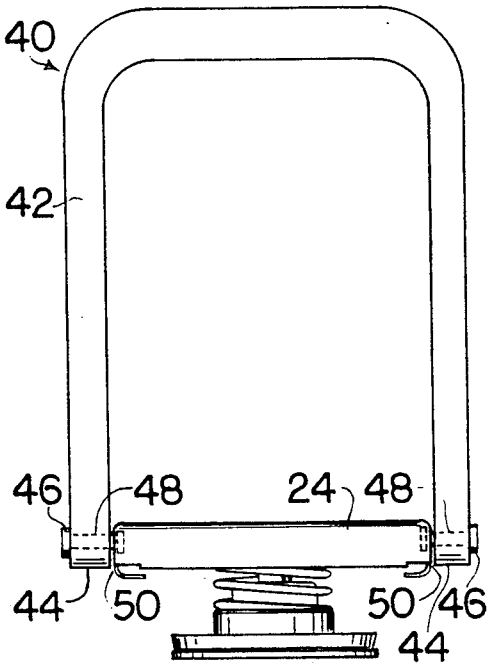
FIG. 6 is a front elevation of another preferred embodiment of the tool for removing radiator caps.

Referring to FIG. 6, there is shown yet another preferred embodiment of a tool for removing radiator caps, shown generally at 40 and comprising U-shaped bail or handle 42 having legs 44 that straddle the radiator cap 24. The tool 40 is fastened to the outer perimeter of the radiator cap 24 by rivets 46 that penetrate apertures 48 in legs 44 and penetrate an outer skirt 50 of the radiator cap 24. The heads of rivets 46 are then flattened so that tool 40 an integral portion of radiator cap 24, designed to be left on radiator cap 24 permanently. Any of the embodiments disclosed herein may be permanently attached to a radiator cap by using rivets or other fasteners that penetrate outer skirt 50 of radiator cap 24 to provide a permanent installation of the tool on radiator cap 24. Tool 40 may similarly be made of polyvinylchloride or other appropriate material.

The embodiment shown in FIG. 6 comprises a unitary combination radiator cap and removal tool which may conveniently be manufactured and sold as a single unit.

In use, the user swings the bail or handle of the tool to an upright position, or a position roughly perpendicular to the plane of the top of radiator cap 24, and turns the bail or handle, and therefore, the radiator cap, counterclockwise while not exerting significant downward force on the tool or the radiator cap. This allows the radiator cap to be moved to the vent position, without any risk of turning the radiator cap so far that it is blown off the radiator. After the pressure inside the engine cooling system has come to equilibrium with the atmospheric pressure, then the user may press down firmly on the bail or handle of the tool for removing radiator caps in order to depress outer skirt 50 of radiator cap 24 enough to allow radiator cap 24 to be rotated past the stop tooth on the outer flange of the radiator filler neck.

Then the user continues turning the radiator cap counterclockwise until it is unscrewed from the radiator filler neck, which takes very little downward force. Then, using the bail or handle of the tool, the user lifts the cap free of the radiator filler neck and sets it aside, providing unobstructed access to the radiator filler neck. The radiator cap may be reinstalled by reversing this procedure. If the radiator and radiator cap have cooled sufficiently the radiator cap can be reinstalled without using the tool, which can be held out of the way while the radiator cap is being installed, without having to remove it from the radiator cap. All embodiments of the invention disclosed herein can be operated in this manner.

Figure 7:
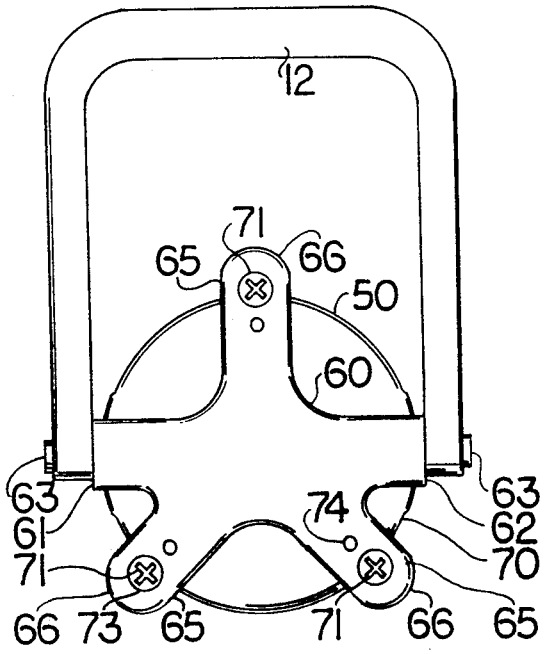
FIG. 7 is a plan view of a third alternative embodiment of the radiator cap removal tool.
Figure 8:
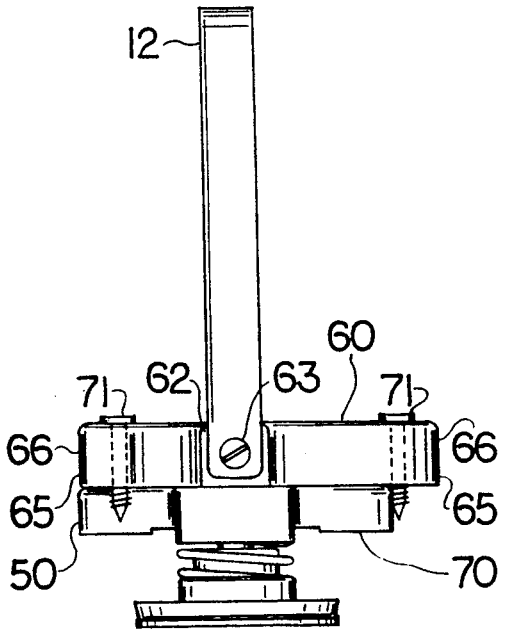
FIG. 8 is a side elevational view of the cap shown in FIG. 7.

Two other embodiments of the radiator cap removal tool are shown in connection with FIGS. 7–13. In FIGS. 7 and 8, the same handle or bail 12 as described in connection with FIG. 1 is employed, but the base plate is different. In this embodiment, star-shaped base 60 is attached at diametrically opposed arms 61 and 62 to the ends of the bail 12 by pivots 63. Arms 65 extend triangularly outwardly and terminate in tips 66 protruding beyond the margins of any underlying radiator cap, such as the cap 70. Cap engaging screws 71 extend through the arms 65 adjacent the tips 66 and selectively positioned in either of two sets of holes 73 and 74 to accommodate caps 70 of either of two diameters. The screws 71 may be longitudinally flattened, with threads ground off for rotational of adjustment and engagement with the sides of different sizes of caps 70. This style of radiator cap removal tool is particularly useful with caps that are circular and do not have projecting legs or ears which would facilitate gripping.

Figure 9:
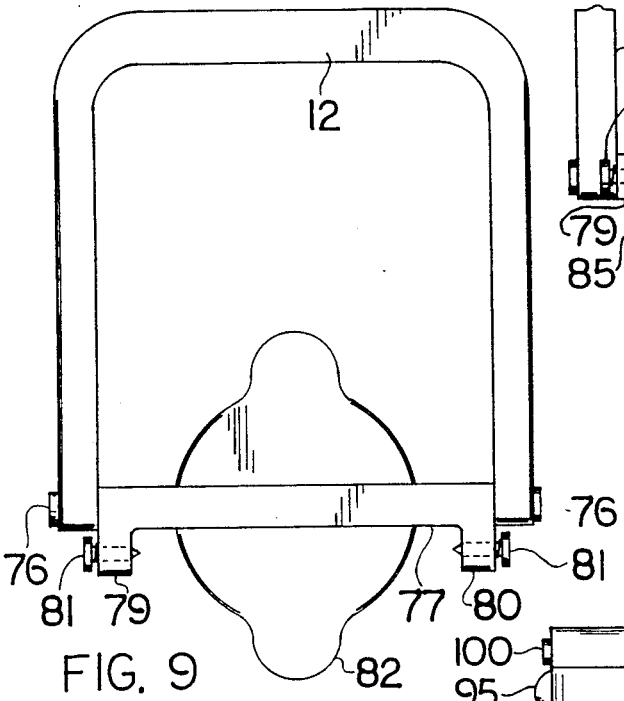
FIG. 9 is a plan view of a fourth alternative embodiment.
Figure 10:
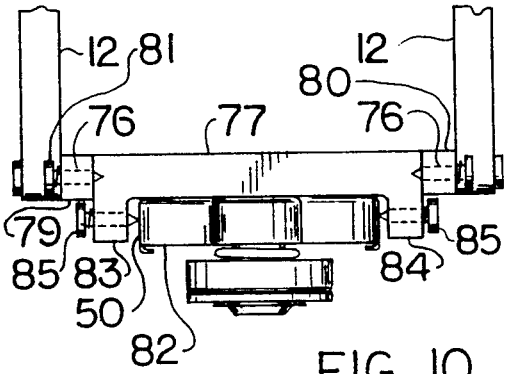
FIG. 10 is an elevational view of the embodiment shown in FIG. 9.

Another type of radiator cap removal tool is shown in connection with FIGS. 9 and 10 wherein a bail 12 is swingably connected by pivots 76 to a crossbar 77 which is designed to accommodate two different sizes of radiator caps. Looking downwardly, FIG. 9, ears 79 and 80 project laterally from the crossbar 77 and have cap engaging screws 81 extending through and arranged in a confronting relation. These screws 81 then engage a cap therebetween, the cap, of course, being an appropriate size and larger than the cap shown in FIG. 9. To use the ears 79 and 80, the crossbar is rotated 90° to the orientation shown in FIG. 9.

To fit the smaller cap size 82, ears 83 and 84 project from the crossbar 77 at a 90° orientation to the ears 79 and 80. These ears 83 and 84 also have screws 85 projecting through to grip the edges of the radiator cap. Selection of either the ears 79 and 80 or 83 and 84 is accomplished by mere rotation of the crossbar 77 to match the diameter of the radiator cap.

Figure 12:
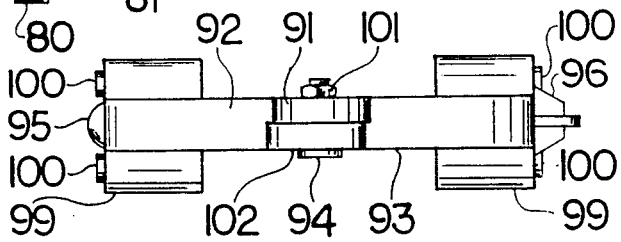
FIG. 12 is a fragmentary view of a portion of the handle assembly of the embodiment shown in FIG. 11.
Figure 11:
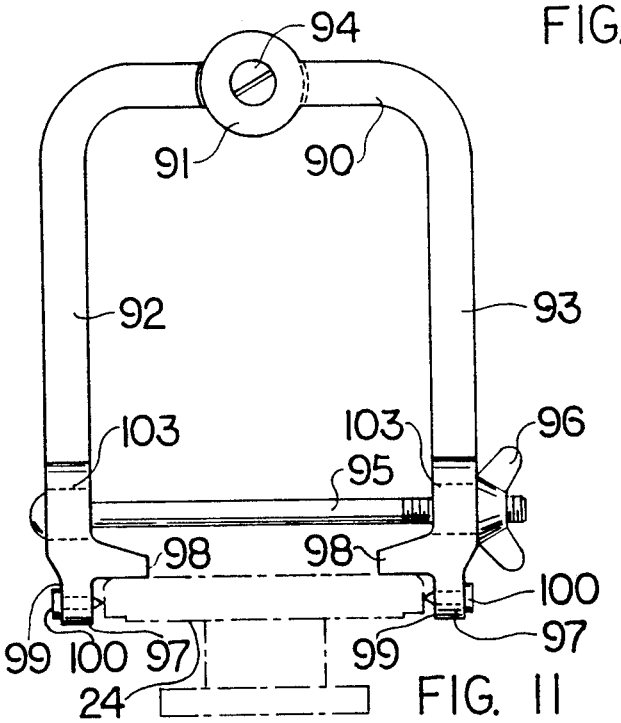
FIG. 11 is an elevational view of a fifth alternative embodiment.
Figure 13:
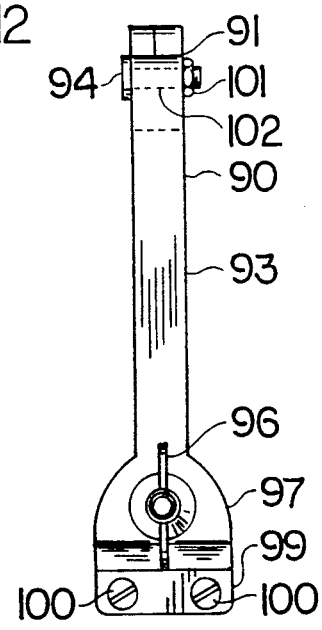
FIG. 13 is a side elevational view of the embodiment shown in FIG. 11.

An embodiment is shown in FIGS. 11 through 13 wherein the handle or bail 90 has an upper pivot connection 91 fastened by a screw 94 inserted through the aperture 102 and a mating nut 101, permitting opposite arms 92 and 93 to be swung toward and away from each other. A crossbolt 95 extends between each of the handle arm ends and has a wingnut 96 for tightening adjustment. At each of the arm ends 97 is formed a lip 98 which bears against the upper surface of a radiator cap and joins an ear 99 through which a screw 100 projects for engagement with the cap sidewall. As shown in FIG. 13, the screws 100 are doubled for additional frictional engagement.

It is to be understood that while certain forms of this invention have been illustrated and described, the invention is not limited thereto, except insofar as such limitations are included in the following claims.

What is claimed and desired to be secured by Letters Patent is as follows:

1. A tool for removing radiator caps, wherein each said radiator cap comprises a radiator cap skirt, comprising:

a. a base having a pair of depending spaced base legs and a pair of upward projecting spaced ears;

b. a bail shaped handle having opposite ends and means for connecting said handle ends to said upward projecting spaced ears of said base, said means for connecting said handle ends to said base further comprises an aperture through, each said ear; an aperture through each said handle end; said handle ends straddling said ears, such that the apertures of said ears and said ends are aligned; and one pin is inserted into each respective aligned aperture; and;

c. means for connecting said depending base legs to said radiator cap skirt.

2. A tool for removing radiator caps, wherein each said radiator cap comprises a radiator cap skirt, comprising:

a. a base plate having two base plate legs and two upwardly protruding opposed ears, each said ear including an aperture therethrough;

b. a U-shaped bail or handle including two depending handle legs, each said handle leg including an aperture;

c. said U-shaped bail connected to said base plate ears by pins; and d. means for attaching said base plate legs to a radiator cap.

3. A tool in accordance with claim 2 wherein said attaching means includes an adhesive.

4. A tool in accordance with claim 2 wherein said base plate further comprises one aperture in each said base plate leg.

5. A tool in accordance with claim 2 wherein said base plate further comprises one aperture in each said base plate leg and said attaching means further comprises a sheet metal screw penetrating each said base plate leg, each said screw being tightened about said perimeter of the radiator cap skirt.

6. A tool in accordance with claim 2 wherein said base plate and said U-shaped bail or handle are made of polyvinylchloride.

7. A unitary radiator cap and tool for removing the radiator cap from a radiator filler neck, comprising:

a) a generally U-shaped bail having a pair of legs, each said leg further comprising an end, and a connecting portion connecting said legs together, each said leg including an aperture in each said leg end;

b) a brace attached to said legs and disposed substantially perpendicularly to said legs at opposite sides of said U-shaped bail at a location intermediate said leg ends and said connecting portion;

c. a radiator cap, said radiator cap further comprising a radiator cap skirt; and d. two gripping mechanical fasteners, one said fastener penetrating said aperture of each said leg, said legs straddling said radiator cap skirt, each said gripping fastener gripping said radiator cap skirt.

8. A tool in accordance with claim 7 wherein said gripping mechanical fasteners comprise sheet metal screws with flattened sides for rotational adjustment with said radiator cap skirt of said radiator cap.

9. A unitary radiator cap and tool for removing the radiator cap from a radiator filler neck, comprising:

a) a generally U-shaped bail or handle having a pair of legs and a connecting portion connecting said legs together, each said leg including an aperture;

b) a radiator cap further comprising a depending skirt and two apertures spaced opposite one another on said depending skirt portion of said radiator cap; and c) two mechanical fasteners penetrating said aperture of each said leg, said legs straddling said depending skirt, one said fastener penetrating said aperture in each said leg and each respective aperture in said skirt.

10. A combination in accordance with claim 9 wherein said fasteners comprise rivets.

11. A tool for removing a radiator cap and radiator cap combination comprising:

a) a radiator cap, said radiator cap further comprising a skirt;

b) a generally U-shaped bail having a pair of legs connected by a connecting portion;

c) each said leg further comprising a lower end and an aperture in each said lower end;

d) a gripping mechanical fastener disposed in each said aperture and bearing against said skirt; and e) whereby said mechanical fasteners secure said tool to said skirt of said radiator cap.

12. A tool according to claim 11 wherein said gripping mechanical fastener comprises sheet metal screws.

13. A unitary radiator cap and tool for removing the radiator cap from a radiator filler neck, comprising:

a) a generally U-shaped bail or handle having a pair of legs connected by a connecting portion, each said leg including an aperture;

b) a radiator cap having two apertures through an outer depending skirt portion of said radiator cap, said apertures being opposite one another;

c) two gripping mechanical fasteners penetrating said apertures in said legs, and said apertures in said outer depending skirt portion.

14. A tool for removing radiator caps, wherein said each radiator cap comprises a skirt, comprising:

a) a base having a pair of spaced depending base legs;

b) a bail shaped handle having opposing ends and means for connecting said handle ends to said base, said connecting means further comprising a pair of upstanding spaced ears attached to said base plate, with each said ear having an aperture therethrough; and aperture through each said handle end; said handle ends straddling said ears, such that said apertures of said ears and said handle ends are aligned and one pin inserted into each respective aligned apertures; and c) means for connecting said depending base legs to said radiator cap skirt.

* * * * *